US007740417B2

(12) United States Patent
Jang

(10) Patent No.: US 7,740,417 B2
(45) Date of Patent: Jun. 22, 2010

(54) CONSTRUCTION METHOD FOR INSTALLING UNDERGROUND PIPES FOR HIGH-TENSION CABLES BY USING TROUGH

(76) Inventor: Young-Hwan Jang, #208-208, Dongbu Golden Apats., 338 Oryu-Dong, Gur-gu, Seoul (KR)

( * ) Notice: Subject to any disclaimer, the term of this patent is extended or adjusted under 35 U.S.C. 154(b) by 0 days.

(21) Appl. No.: 12/254,386

(22) Filed: Oct. 20, 2008

(65) Prior Publication Data

US 2010/0098501 A1 Apr. 22, 2010

(51) Int. Cl.
*F16L 1/024* (2006.01)

(52) U.S. Cl. ..... 405/157

(58) Field of Classification Search ..... 405/149, 405/157, 184.1, 184.2, 184.4, 184.5
See application file for complete search history.

(56) References Cited

U.S. PATENT DOCUMENTS 2,773,512 A * 12/1956 Burk ..... 405/184.5
2,972,968 A * 2/1961 Stafford ..... 405/155
3,650,119 A * 3/1972 Sparling ..... 62/50.7
4,653,958 A * 3/1987 Anderson et al. ..... 405/157
5,482,403 A * 1/1996 Jones et al. ..... 405/157
6,830,412 B2 * 12/2004 Perez ..... 405/180

FOREIGN PATENT DOCUMENTS

JP 8-168153 * 6/1996

* cited by examiner

*Primary Examiner*—John Kreck

(57) ABSTRACT

A construction method for installing underground pipes for high-tension cables uses a trough. The method includes the steps of forming an excavation trench by excavating the ground, installing the trough on the bottom of the excavation trench, pouring sand into the space section, placing the underground pipes on the sand, pouring again the sand onto the underground pipes, filling a gap formed between the trough and the excavation trench using sand and gravel, forming an upper protecting member on the trough, and performing surface treatment by using road pavement materials.

6 Claims, 10 Drawing Sheets

S50

S40

S50

CONSTRUCTION METHOD FOR INSTALLING UNDERGROUND PIPES FOR HIGH-TENSION CABLES BY USING TROUGH

BACKGROUND OF THE INVENTION (a) Field of the Invention

The present invention relates to a construction method for installing underground pipes for high-tension cables by using a trough, capable of installing high-tension cables by excavating the ground. More particularly, the present invention relates to a construction method for installing underground pipe for high-tension cables by using a trough, which can reduce the construction cost by omitting installation work for temporal structures, can improve working efficiency by shortening the period of construction, can facilitate repair and maintenance work while preventing the underground pipes used for installing the high-tension cables from being broken, and can enable stable construction work for other facilities.

(b) Description of the Related Art

In general, a sand placing scheme is mainly used to install underground pipes.

FIGS. 1 and 2 are views showing underground pipes 1 installed through the sand placing scheme. Referring to FIGS. 1 and 2, an excavation trench is formed by performing excavation work such that inclined surfaces are formed at left and light sides of the excavation trench at a predetermined angle and a predetermined depth. Then, H beams 3*a* are installed at a predetermined interval to prevent an accident caused by the landslide occurring at both sides of the excavation trench and to protect the underground pipes 1 used for installing high-tension cables therein. In addition, transverse plates 3*b* are provided between the H beams 3*a*, thereby establishing a temporal structure 3.

Then, the underground pipes 1, which are used for installing the high-tension cable, are installed on the bottom of the excavation trench by alternately placing the underground pipes 1 and sand s. After that, concrete 130 is casted onto the underground pipes 1 and then the temporal structure 3 is removed.

If the underground pipes are installed through the sand placing scheme, the construction cost can be reduced. However, since the concrete is casted onto the underground pipes after pure sand is placed together with the underground pipes, strength of the construction may be remarkably lowered. In addition, when other facilities are installed in the vicinity of the underground pipes, sand is collapsed at the side of the excavation trench, so that the underground pipes are easily damaged.

In order to overcome the above problem, a concrete casting scheme is recently used to install the underground pipes. According to the concrete casting scheme, after forming the excavation trench using an excavator and installing the temporal structures, a form is installed in the excavation trench, a cable is installed in the form, and concrete is casted into the form.

However, although the concrete casting scheme can improve strength of construction as compared with the sand placing scheme, the construction cost may be increased. In addition, since the temporal structures must be uniformly installed over the whole construction area due to the concrete casting, the cost for installing the temporal structures may be increased and labor force is wasted, so that working efficiency is lowered.

In addition, it takes much time to cure the concrete in the form, so the working efficiency is remarkably lowered and repair work is very difficult.

Further, the construction cost is also increased due to concrete casting work.

SUMMARY OF THE INVENTION

The present invention has been made to solve the above problems occurring in the prior art, and an object of the present invention is to provide a construction method for installing underground pipes for high-tension cables by using a trough, capable of reducing the construction cost by omitting installation work for temporal structures and improving working efficiency by shortening the period of construction.

Another object of the present invention is to provide a construction method for installing underground pipes for high-tension cables by using a trough, capable of improving working safety by protecting the underground pipes, which are used for installing the high-tension cables, using the trough that receives the underground pipes therein and facilitating repair and maintenance work.

Still another object of the present invention is to provide a construction method for installing underground pipes for high-tension cables by using a trough, capable of enabling workers to stably perform construction work in the center of city without being influenced by peripheral environment even if excavation work for other facilities is performed in the vicinity of the working area.

In order to accomplish the above object, according to the present invention, there is provided a construction method for installing underground pipes for high-tension cables by using a trough having a U shape and including a space section and a coupling groove formed at one side end of the trough, the method comprising the steps of: forming an excavation trench by excavating a ground to install the trough in the excavation trench, in which inclined surfaces are formed at both sides of the excavation trench at a predetermined inclination angle and a width of a bottom of the excavation trench is identical to a width of the trough; installing the trough on the bottom of the excavation trench by coupling a plurality of troughs through the coupling groove; pouring a predetermined amount of sand into the space section formed in the trough, placing the underground pipes, which receive the high-tension cables therein, on the sand at a predetermined interval, and pouring again the sand onto the underground pipes while flattening a top of the sand, thereby burying the underground pipes in the sand; filling a gap formed between an outer surface of the trough and a sidewall of the excavation trench using a mixture of sand and gravel until a height of the mixture is level with a height of the trough; forming an upper protecting member on a top of the trough by using concrete; and performing surface treatment by coating road pavement materials on the upper protecting member.

BRIEF DESCRIPTION OF THE DRAWINGS

The above and other advantages of the present invention will become readily apparent with reference to the following detailed description when considered in conjunction with the accompanying drawings wherein.

DESCRIPTION OF THE EMBODIMENTS

Hereinafter, a construction method for installing underground pipes for high-tension cables by using a trough will be explained in detail with reference to the accompanying drawings.

Figure 1:
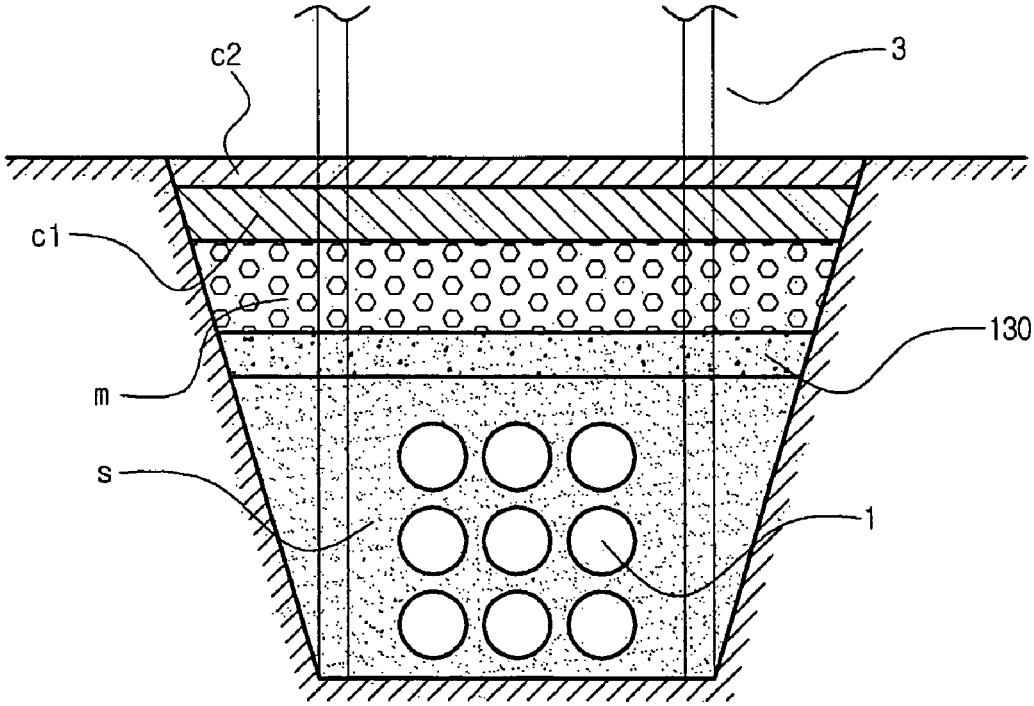
Fig. 1 PRIOR ART
FIG. 1 is a sectional view showing conventional underground pipes.
Figure 2:
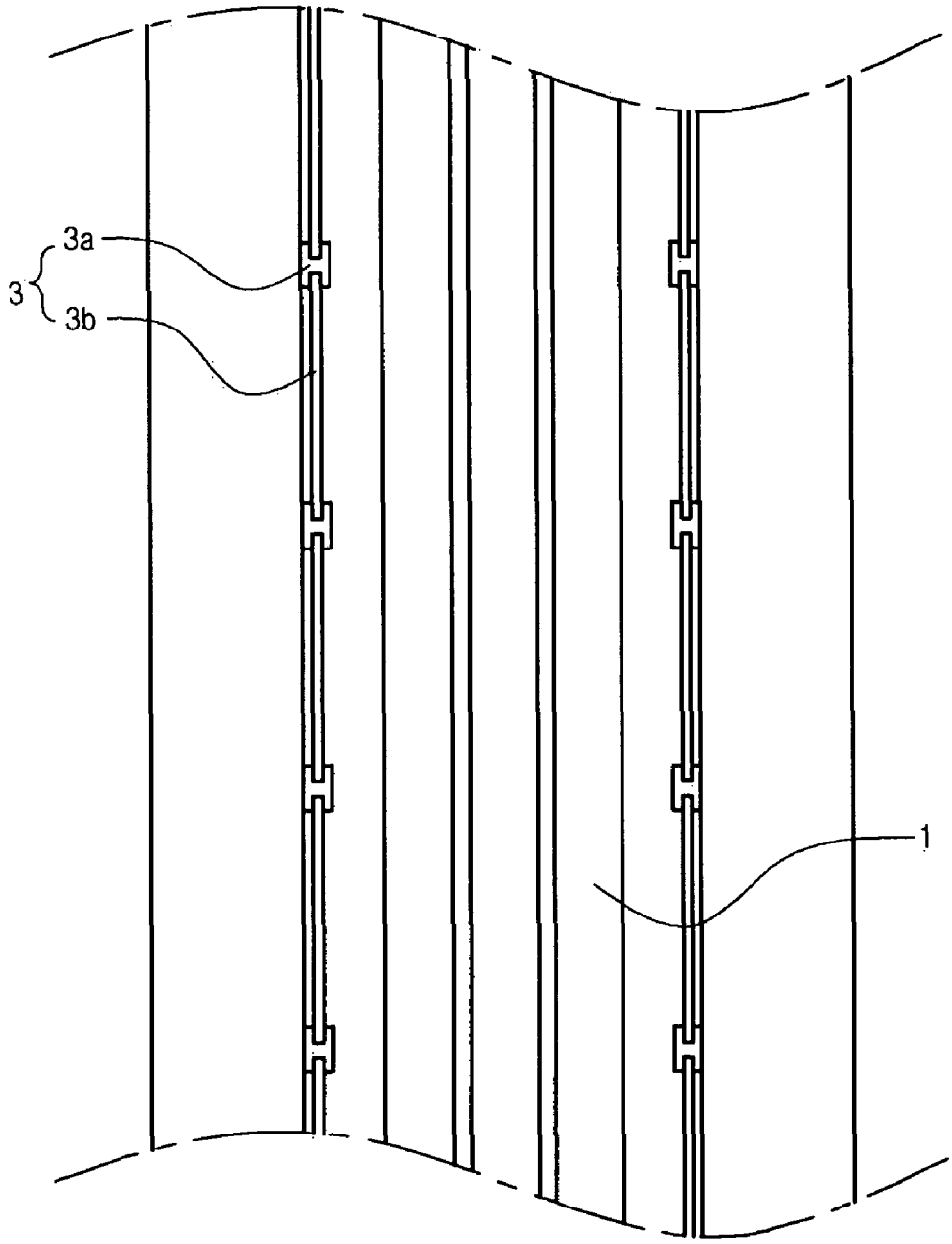
Fig. 2 PRIOR ART
FIG. 2 is a plan view of FIG. 1.
Figure 3:
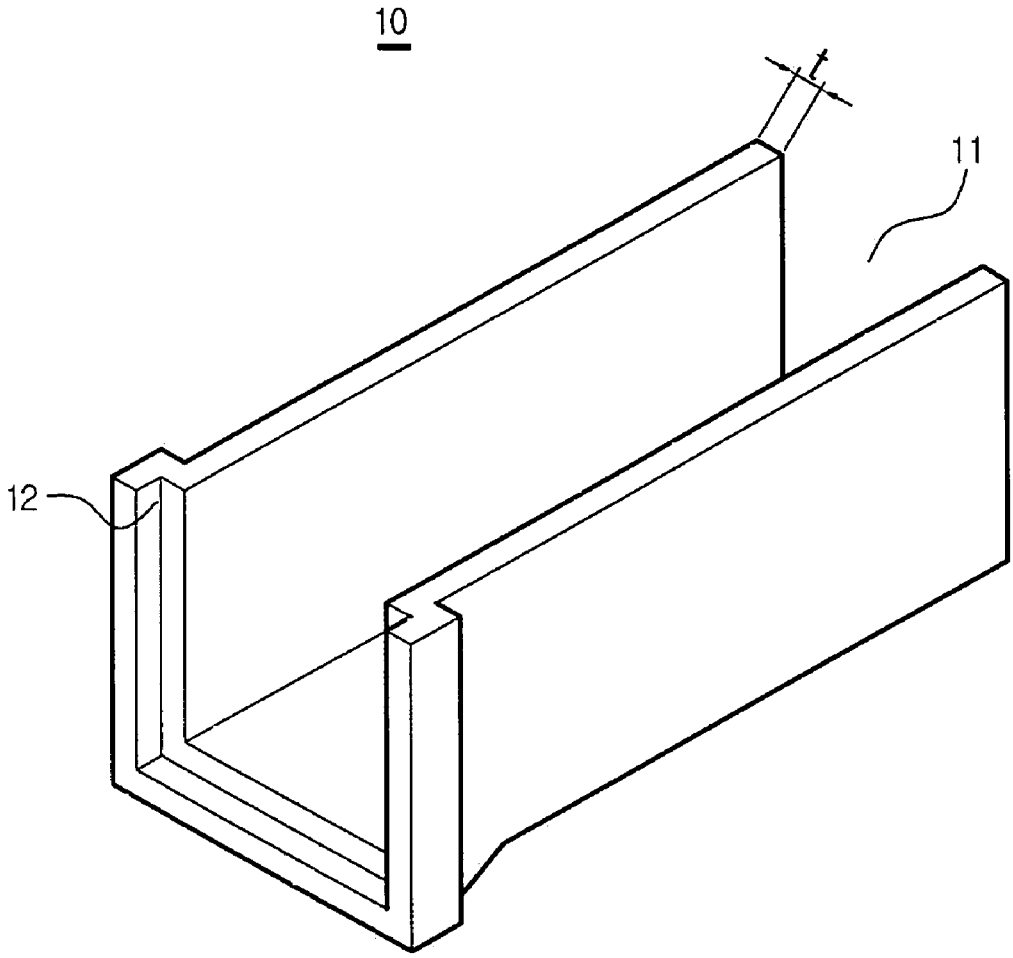
FIG. 3 is a perspective view showing a trough according to the present invention.

As shown in FIG. 3, the trough 10 used for the construction method of the present invention includes a space section 11 for installing underground pipes 1, which are used for installing high-tension cables, and a coupling groove 12 formed at one side end of the trough 10 in such a manner that a plurality of troughs can be coupled to each other through the coupling groove 12 when construction work is performed to install the underground pipes.

A thickness t of the trough 10 may vary depending on the size and number of the underground pipes 1 disposed in the space section 11 of the trough 10 to install the high-tension cables therein.

For instance, if the size and number of the underground pipes 1 used to install the high-tension cables therein are too small, the trough 10 is fabricated with a thick thickness such that the amount of sand used for the construction woke can be saved. In addition, if the size and number of the underground pipes 1 used to install the high-tension cables therein are too large, the trough 10 is fabricated with a thin thickness to enlarge the size of the space section 11 such that a sufficient amount of the underground pipes 1 can be installed in the space section 11.

Figure 4:
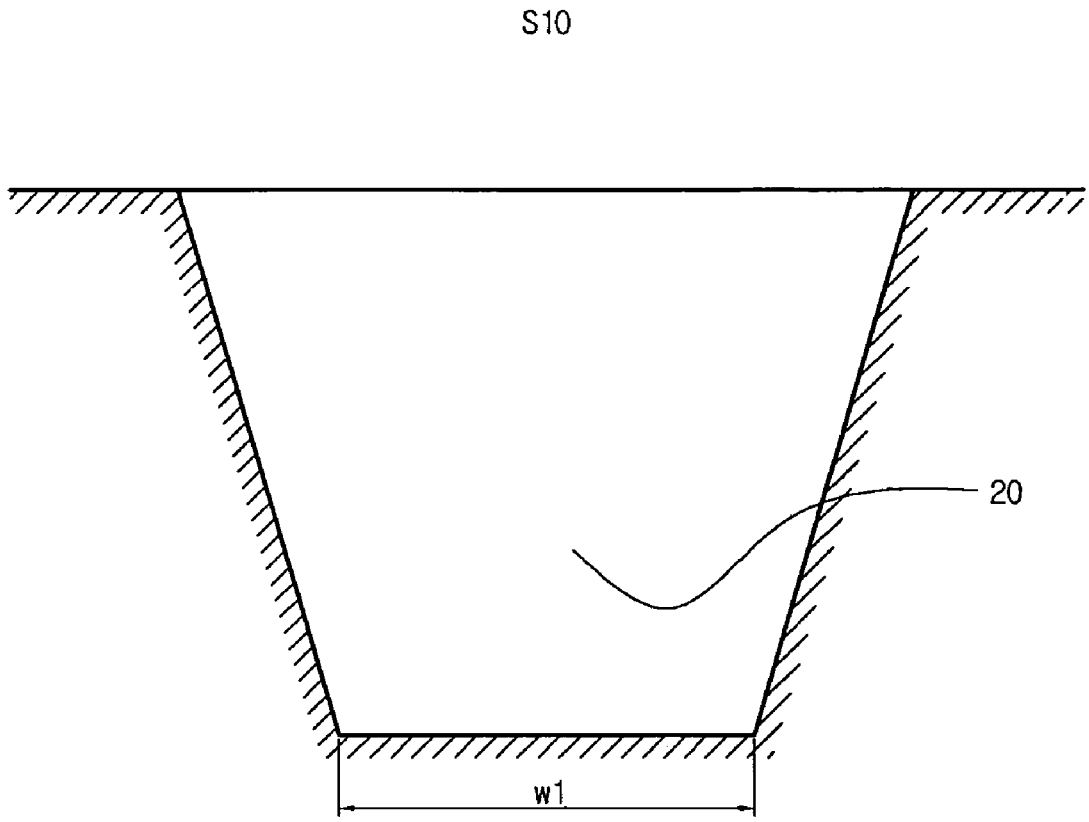
FIG. 4 is a sectional view showing a step of forming an excavation trench according to the present invention.

When the construction work is performed by using the trough 10 having the above structure, as shown in FIG. 4, excavation work is performed on the ground to form an excavation trench 20 for installing the trough 10 such that inclined surfaces having a predetermined inclination angle are formed at both sides of the excavation trench 20 (S10).

In the case of soft ground, the inclination angle of the inclined surfaces is gently reduced such that soil can be prevented from being collapsed. Preferably, a width w1 of the bottom of the excavation trench 20 is identical to a width w2 of the trough 10 such that the trough 10 can be easily installed on the bottom of the excavation trench 20.

Figure 5:
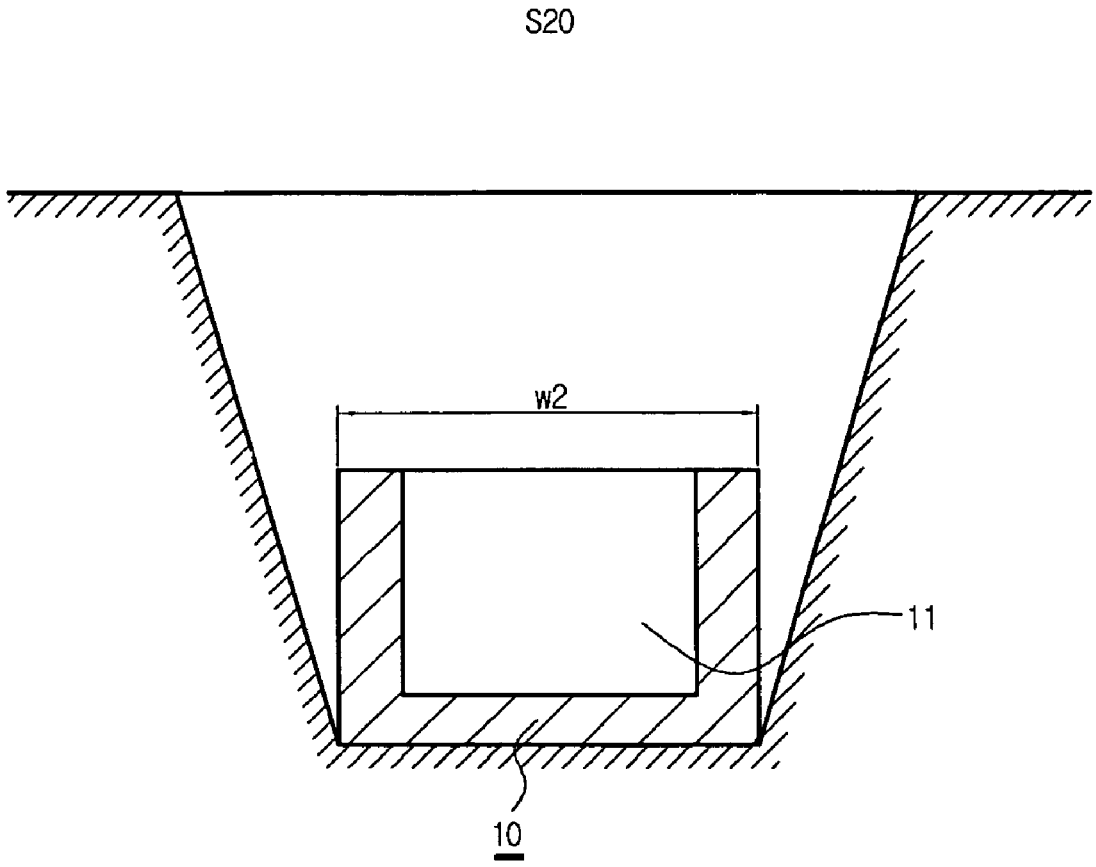
FIG. 5 is a sectional view showing a step of installing a trough according to the present invention.

Then, as shown in FIG. 5, the trough 10 is installed on the bottom of the excavation trench 20 (S20). At this time, a plurality of troughs 10 can be installed in the excavation trench 20 by coupling the troughs 10 to each other through the coupling groove according to the construction length and the length of the underground pipes 1 used for installing the high-tension cables.

Figure 6:
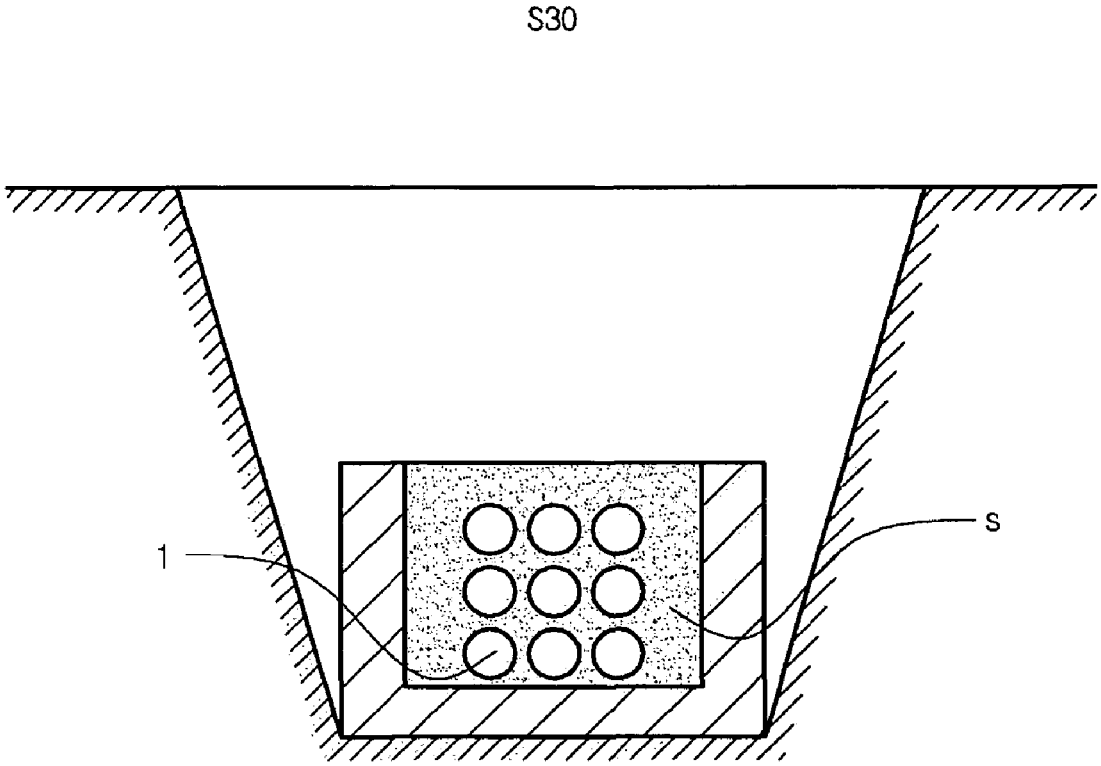
FIG. 6 is a sectional view showing a step of burying underground pipes according to the present invention.

Meanwhile, as shown in FIG. 6, the underground pipes 1 for installing the high-tension cables are installed in the space section 11 formed in the trough 10 while maintaining a predetermined interval between the underground pipes 1, and sand s is poured onto the underground pipes 1 (S30). In this manner, a plurality of underground pipes 1 can be installed in the trough 10 as required by the worker.

After the underground pipes 1 used for installing the high-tension cables have been installed in the trough 1, the sand s is poured onto the underground pipes 1 until the height of the sand s is level with the height of the trough 10.

Since the underground pipes 1 used for installing the high-tension cables are installed in the trough 10 in a state in which the trough 10 has been installed in the excavation trench 20, the construction work can be performed without installing the temporal structure 3, so that working safety is improved and the labor force is saved, so that the construction cost can be reduced.

Figure 7:
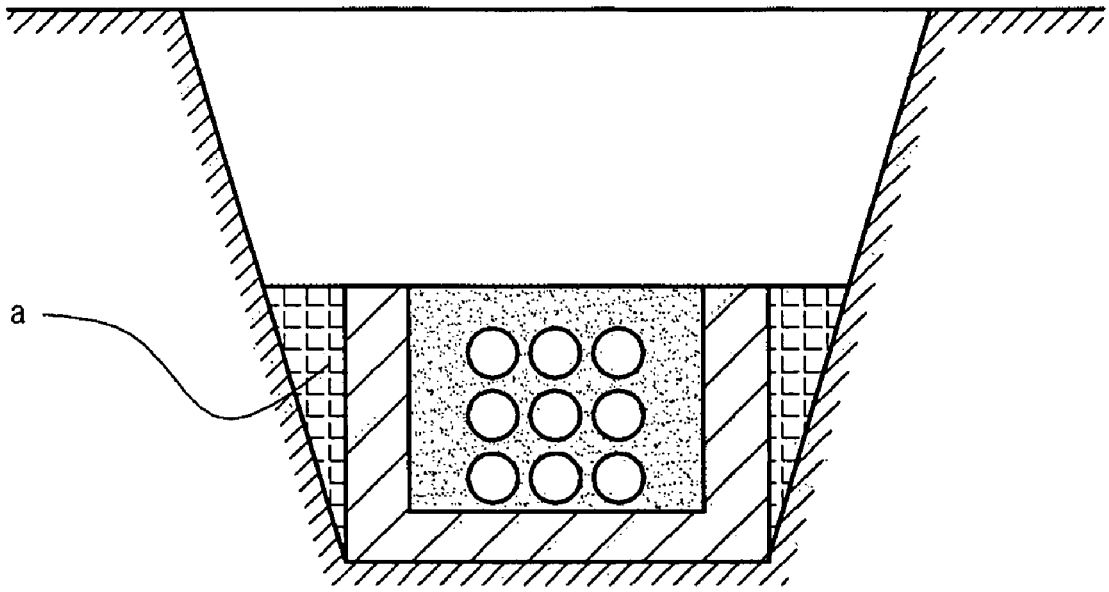
FIG. 7 is a sectional view showing a step of filling a gap formed in an excavation trench according to the present invention.

After that, as shown in FIG. 7, a gap a formed between the excavation trench 20 and the trough 10 is filled with a mixture of sand and gravel (S40). At this time, in order to facilitate the post process, the mixture is filled in the gap until the height of the mixture is level with the height of the trough 10.

If the gap filling work has been completed, an upper protecting member 30 is formed on the trough 10 by using concrete in order to protect the underground pipes 1 installed in the space section 11 of the trough 10 (S50).

Figure 8:
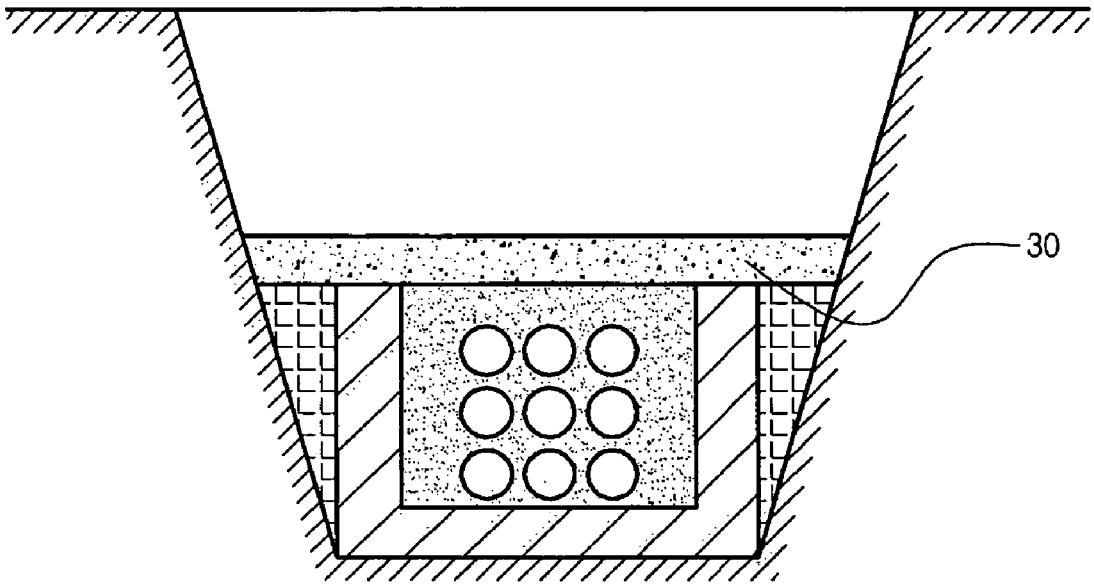
FIG. 8 is a sectional view showing a step of forming an upper protecting member according to an embodiment of the present invention.
Figure 9:
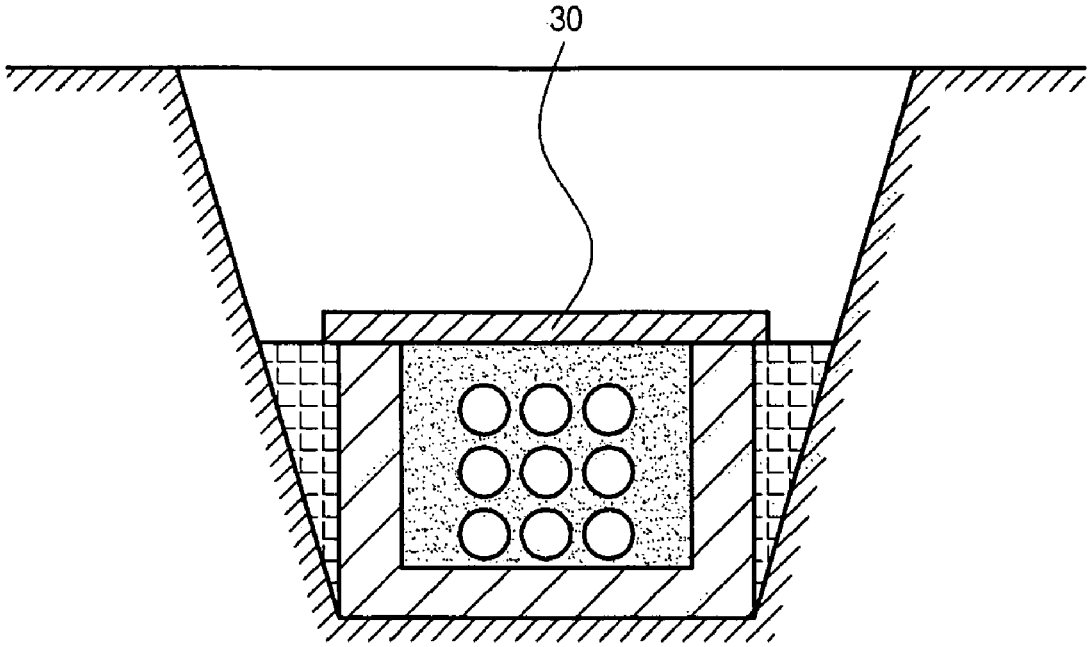
FIG. 9 is a sectional view showing an upper protecting member according to another embodiment of the present invention.

The upper protecting member 30 can be formed through various schemes. According to the present invention, as shown in FIG. 8, the upper protecting member 30 can be formed by casting concrete onto the top of the trough 10 and the gap a. Further, as shown in FIG. 9, after preparing the upper protecting member 30 having the length identical to the width of the space section 11 of the trough 10 by using concrete, the upper protecting member 30 is placed on the top of the trough 10. In this case, the period of construction can be shortened.

Figure 10:
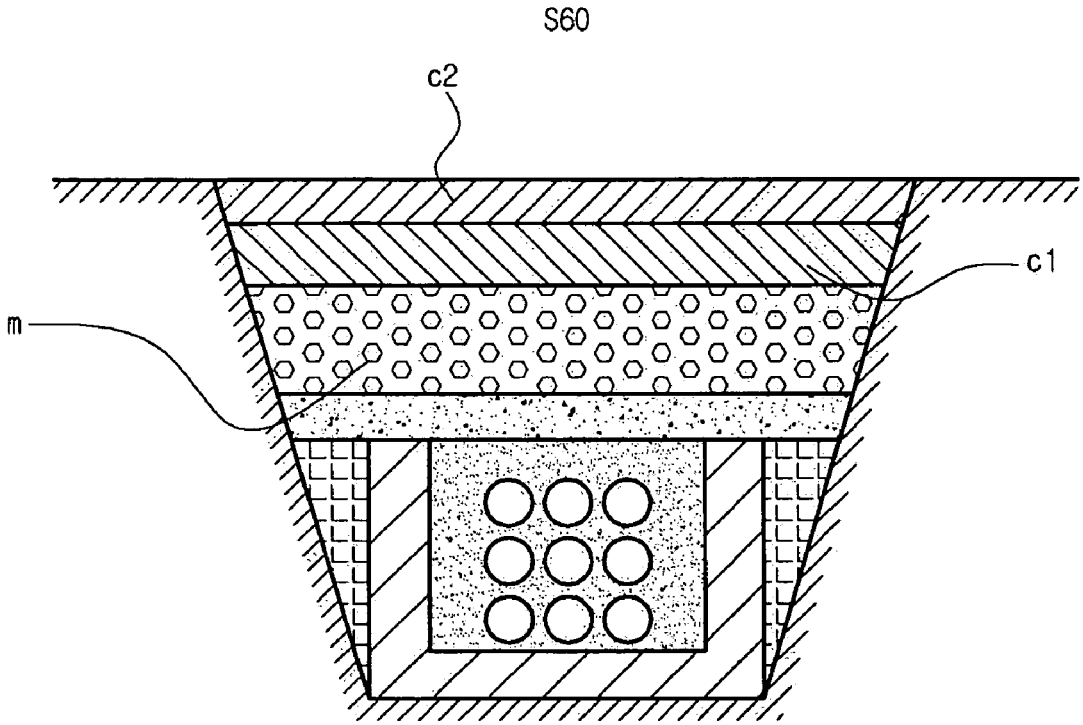
FIG. 10 is a sectional view showing a step of treating a surface according the present invention.

After that, as shown in FIG. 10, a mixing layer m, a prime coating layer c1, a tack coating layer c2 are sequentially formed on the protecting member 30 by using road pavement materials, thereby completing the construction work according to the present invention.

As described above, according to the construction method for installing underground pipes for high-tension cables by using the trough of the present invention, the temporal structure is not needed so that the construction cost can be reduced and the period of construction can be shortened, thereby improving working efficiency.

In addition, since the construction work is performed by using the trough that receives the underground pipes used for installing the high-tension cables, the underground pipes can be protected during the construction work, so that the workings safety can be improved and repair and maintenance work can be facilitated.

Further, the construction work can be stably performed in the center of city without being influenced by peripheral environment even if excavation work for other facilities is performed in the vicinity of the working area.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A construction method for installing underground pipes for high-tension cables by using a trough having a U shape and including a space section and a coupling groove formed at one side end of the trough, the method comprising the steps of:

forming an excavation trench by excavating a ground to install the trough in the excavation trench, in which inclined surfaces are formed at both sides of the excavation trench at a predetermined inclination angle and a width of a bottom of the excavation trench is identical to a width of the trough;

installing the trough on the bottom of the excavation trench by coupling a plurality of troughs through the coupling groove;

pouring a predetermined amount of sand into the space section formed in the trough, placing the underground pipes, which receive the high-tension cables therein, on the sand at a predetermined interval, and pouring again the sand onto the underground pipes while flattening a top of the sand, thereby burying the underground pipes in the sand;

filling a gap formed between an outer surface of the trough and a sidewall of the excavation trench using a mixture of sand and gravel until a height of the mixture is level with a height of the trough;

forming an upper protecting member on a top of the trough by using concrete;

filling a mixing layer over the upper protecting member, wherein the mixing layer comprises a material that is different from (a) the sand within the space section of the trough, and (b) the mixture of sand and gravel within the gap; and performing surface treatment by coating road pavement materials over the mixing layer.

2. The construction method as claimed in claim 1, wherein a thickness of the trough is variable depending on a size and a number of the underground pipes installed in the space section of the trough.

3. The construction method as claimed in claim 1, wherein, the sand is poured onto the underground pipes until a height of the sand is level with a height of the trough when the sand is poured onto final underground pipes.

4. The construction method as claimed in claim 1, wherein the upper protecting member is formed through concrete casting.

5. The construction method as claimed in claim 4, wherein the upper protecting member contacts the trough and the sides of the excavation trench.

6. The construction method as claimed in claim 1, wherein the upper protecting member is previously fabricated by using concrete and is placed on a top of the trough.

* * * * *